US006733237B2

(12) United States Patent
Ingistov

(10) Patent No.: US 6,733,237 B2
(45) Date of Patent: May 11, 2004

(54) METHOD AND APPARATUS FOR MOUNTING STATOR BLADES IN AXIAL FLOW COMPRESSORS

(75) Inventor: Steve Ingistov, Los Angeles, CA (US)

(73) Assignee: Watson Cogeneration Company, Warrenville, IL (US)

( * ) Notice: Subject to any disclaimer, the term of this patent is extended or adjusted under 35 U.S.C. 154(b) by 0 days.

(21) Appl. No.: 10/114,455

(22) Filed: Apr. 2, 2002

(65) Prior Publication Data

US 2003/0185678 A1 Oct. 2, 2003

(51) Int. Cl.[7] ..... F01D 9/04
(52) U.S. Cl. ..... 415/209.2; 415/217; 29/889.22
(58) Field of Search ..... 415/209.2, 209.3, 415/136, 138, 172 A, 216, 217, 218, 189, 199, 210.1; 29/889.22

(56) References Cited

U.S. PATENT DOCUMENTS

| | | | | |
|---|---|---|---|---|
| 2,661,147 A | | 12/1953 | Anderson | |
| 3,938,906 A | * | 2/1976 | Michel et al. | 415/139 |
| 3,975,114 A | * | 8/1976 | Kalkbrenner | 415/217 |
| 4,063,845 A | * | 12/1977 | Allen | 415/134 |
| 4,142,827 A | | 3/1979 | Vinciguerra | |
| 4,537,024 A | * | 8/1985 | Grosjean | 60/39.161 |
| 5,071,313 A | * | 12/1991 | Nichols | 415/134 |
| 5,088,888 A | * | 2/1992 | Bobo | 415/170 |
| 6,296,443 B1 | * | 10/2001 | Newman et al. | 415/209.2 |
| 6,343,912 B1 | * | 2/2002 | Manteiga et al. | 415/138 |

FOREIGN PATENT DOCUMENTS

| | | |
|---|---|---|
| EP | 0384166 A | 8/1990 |
| EP | 0531133 A | 3/1993 |
| EP | 1104836 A1 | 6/2001 |
| EP | 1106784 A1 | 6/2001 |

* cited by examiner

*Primary Examiner*—Edward K. Look
*Assistant Examiner*—J. M. McAleenan
(74) *Attorney, Agent, or Firm*—Patrick J. Kim; F. Lindsey Scott

(57) ABSTRACT

An axial flow compressor and a method for mounting the stator blades in the compressor. The compressor is comprised of a stator casing having a rotor axially positioned therein. The casing has internal circumferential grooves into which the stator blades are equally spaced therein. Resilient spacers, e.g. leaf spring, are positioned within any spaces which might exist in the groove after all of the blades have been properly spaced around the groove.

5 Claims, 3 Drawing Sheets

METHOD AND APPARATUS FOR MOUNTING STATOR BLADES IN AXIAL FLOW COMPRESSORS

DESCRIPTION

1. Technical Field

The present invention relates to axial flow compressors and in one aspect relates to a method and apparatus for mounting the stator blades in axial flow compressors wherein resilient spacers are used between at least some of the stator blades to compensate for wear and maintain the stability of the stator blades during extended operation of the compressor.

2. Background

Axial flow compressors are well known and are commonly used in many commercial operations. For example, in operations involving gas turbines (i.e. the generation of electricity), axial flow compressors are typically used to supply the compressed air necessary to support the combustion needed for driving the turbine. While the details between particular axial flow compressors may vary, generically, an "axial flow compressor" is a compressor which is basically comprised of a rotor axially mounted inside of a stator casing. Both the rotor and stator casing include rows of blades which rotate with respect to each other to compress the gas as the gas flows through the compressor.

Typically, the stator of an axial flow compressor is comprised of rows of stationary blades that are attached to the compressor casing within which a rotor is coaxially mounted. The inner surface of the casing has a plurality of circumferential grooves (e.g. up to 17 or more) formed therein which are axially spaced from each other along the casing. A plurality of individual stator blades are positioned, side by side, into each groove and are radially spaced around the groove in a manner which will provide the best aerodynamic effect as a gas flows therethrough. That is, desirably the stator blades will be equally spaced from each other about the inner circumference of the casing, i.e. the blades will be equally spaced within the 360° of each stage of compression.

Ideally, each individual stator blade would be identical in size and shape to all of the other blades so that the mounting base of each blade would firmly abut the bases of the blades on either side thereof when all of the blades were positioned within a particular groove in the casing. This physical contact between adjacent blades would insure that the blades were all equally spaced and would firmly fix the blades in position so that none of the blades could move within the groove once they were in position.

However, in the real world, due to the relatively large number of blades that may be required in each row (e.g. up to 80 or more blades) and due to the tolerances involved in standard manufacturing processes, a certain amount of "slop" is almost sure to remain when all of the stator blades are loaded into a particular groove. That is, there is always a very small, unfilled space remaining within the groove after all stator blades have been positioned which, if not compensated for, will allow slight movement between certain stator blades within the grooves which, in turn, can cause severe problems during operation of the compressor.

To compensate for this remaining space in known axial flow compressor, manufacturers of these compressors normally provide flat spacers, i.e. "shims", of different thicknesses to specially match the profile of the particular groove in which the stator blades are positioned. As will be understood in the art, these individual shims are positioned between selected stator blades as needed to provide equal spacing of the blades and fix the blades in position. Normally, only a relatively few shims will be needed since the majority of the mounting bases of adjacent blades will be in abutment with each other.

While these flat shims function well in properly spacing the stator blades and holding them in a fixed relationship to each other, the shims undergo continuously micro-motion and other detrimental forces during operation of the compressor which can result in severe wear on the shims. That is, the profiled tabs, which hold the flat shim in the groove within the casing, can break or be eroded away whereupon the broken shim can "wiggle" out from between the stator blades and into the interior of the compressor casing. As will be recognized, such a loose piece of metal (i.e. a loose shim) can do serious damage to both the stator and the rotating rotor blades. Further, once the broken shim no longer fills the space between adjacent stator blades, those blades are now free to start vibrating, which can quickly lead to a catastrophic failure of the compressor.

SUMMARY OF THE INVENTION

The present invention provides a axial flow compressor and a method and apparatus for mounting the stator blades in the compressor whereby the micro-motion and other detrimental forces on the spacers (e.g. shims) between the stator blades are alleviated.

More specifically, the axial flow compressor of the present invention is comprised of a stator casing having a rotor axially positioned therein. The casing has at least one internal circumferential groove into which a plurality of individual stator blades are positioned. Typically, the casing will have a plurality of axially-spaced grooves (e.g. up to 17 or more) with each groove effectively representing a stage of compression. As with prior art compressors of this type, due to the large number of stator blades (e.g. up to 80 or more) and the machine tolerances involved, there is usually a small space remaining within the groove after all of the stator blades have been positioned therein.

The blades are then readjusted until substantially the same distance exists between each of the blades. It should be recognized that there will not necessarily be a space between every two blades but more likely, there will only spaces between a relatively few blades. In accordance with the present invention, a resilient spacer is positioned within each space so that all of the blades are substantially equally positioned and are firmly held against movement within the groove.

Preferably, each resilient spacer is formed in the shape of a leaf spring which is basically a resilient, curved plate comprised of a corrosion-resistant, hardened material (e.g. stainless steel). The curved plate has a tab at each side thereof which, in turn, is adapted to fit into the internal circumferential groove on the casing to hold the spacer in the groove. The overall thickness of the curved plate, which may vary (e.g. 1/16" to 3/32" or the like), when in a relaxed state is substantially equal to the space between two adjacent stator blades into which the curved plate is to be positioned.

The resilient spacers of the present invention not only spaces and prevents movement of the blades within the groove but they also provide a resilient force respective two adjacent stator blades whereby the aerodynamic loads, present during operation of compressor, will compress/relax the resilient spacers thereby virtually eliminating the micro-motion and inter-fretting of the shims previously encountered by the flat shims typically used in prior art axial flow compressors.

BRIEF DESCRIPTION OF THE DRAWINGS

The actual construction, operation, and apparent advantages of the present invention will be better understood by referring to the drawings which are not necessarily to scale and in which like numerals refer to like parts and in which.

While the invention will be described in connection with its preferred embodiments, it will be understood that this invention is not limited thereto. On the contrary, the invention is intended to cover all alternatives, modifications, and equivalents which may be included within the spirit and scope of the invention, as defined by the appended claims.

BEST KNOWN MODE FOR CARRYING OUT THE INVENTION

Figure 1:
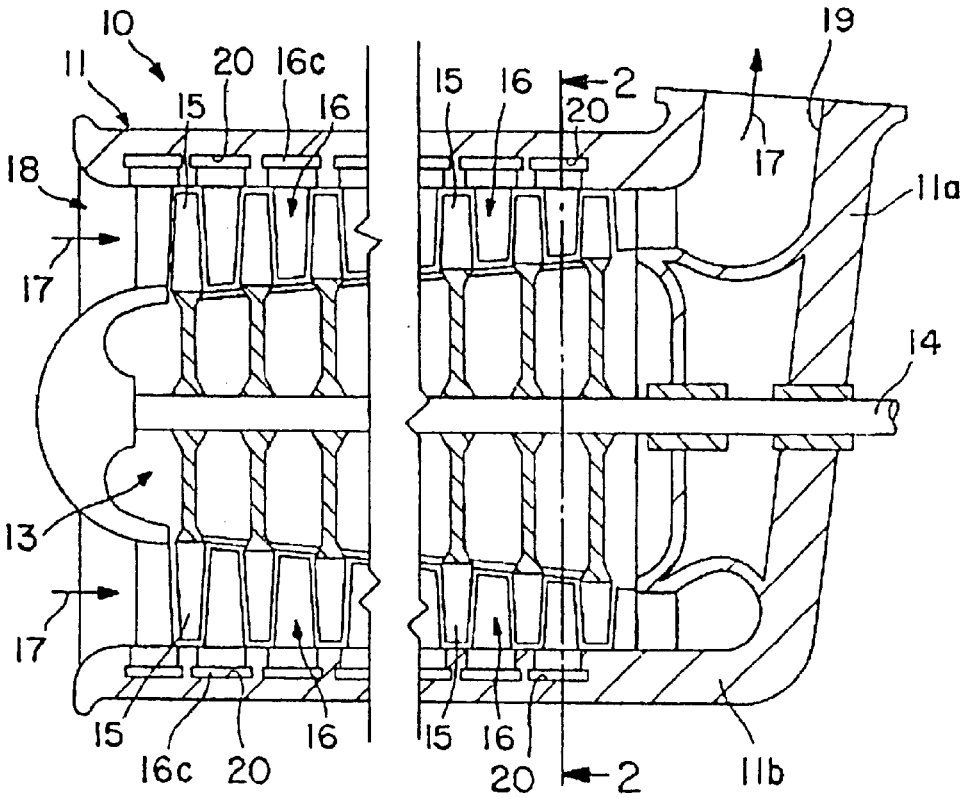
FIG. 1 is a sectional view of a representative, axial flow compressor of the type in which the present invention is incorporated.

Referring more particularly to the drawings, FIG. 1 illustrates an axial flow compressor 10 of the general type in which the present invention can be incorporated. It will be understood in the art that certain details may vary between particular axial flow compressors without departing from the present invention.

Figure 2:
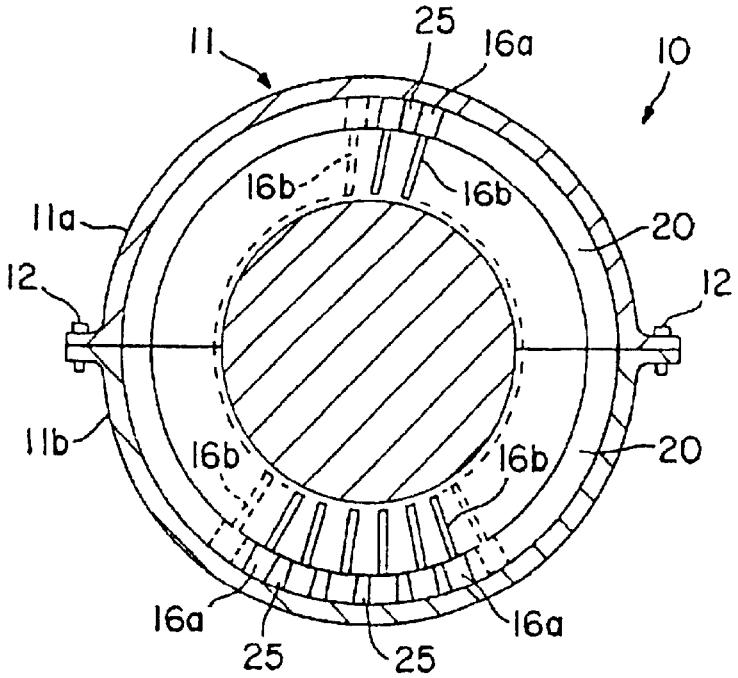
FIG. 2 is cross-sectional view taken along line 2—2 of FIG. 1.

Axial flow compressor 10 is comprised of a casing 11 which is typically made in two halves or sections 11*a*,11*b* which are secured together by bolts 12 or the like (FIG. 2). Rotor 13 is coaxially mounted inside casing 11 and is driven by shaft 14 which, in turn, is driven by any appropriate power source. Rotor 13 has several rows of rotor blades 15 (only some numbered for clarity) which are axially spaced thereon which cooperate with respective rows of stator blades 16 (only some numbered for clarity) to compress gas (e.g. air, arrows 17) in stages as the gas flows through inlet 18, through casing 11, and out outlet 19.

Figure 3:
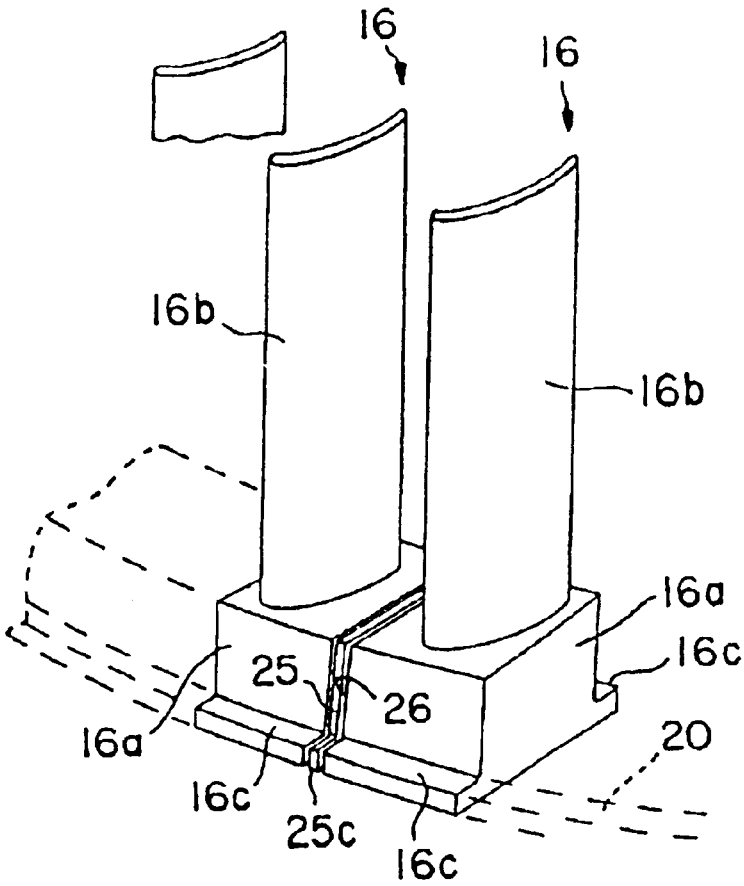
FIG. 3 (PRIOR ART)
FIG. 3 is an enlarged, perspective view of two, adjacent stator blades with the compressor casing broken away in dotted lines showing a prior art shim therebetween.

It is common in axial flow compressors such as compressor 10 for the stator blades 16 to be constructed as best seen in FIG. 3. Each blade 16 comprises a mounting base 16*a* on which blade 16*b* is affixed. Base 16*a* has tabs 16*c* extending from the lower portion of the two, opposed sides which lie substantially perpendicular to blade 16*b*.

Casing 11 has a plurality of grooves 20 (only some numbered for clarity) which are spaced axially along the inside surface of casing 11. Since the stator blades are assembled into each of the grooves 20 in the same manner, only one groove 20 will be discussed in detail. As will be understood in the art, tabs 16*c* on the mounting base 16*a* of an individual stator blade 16 are slid into groove 20 while sections 11*a*, 11*b* are disassembled.

Stator blades 16 are inserted into groove 20 in 11*a*/11*b* until no more blades can be added. At this time, a certain amount of space will likely remain in the groove. The blades 16 are adjusted to determine how many of what size spacers or shims are needed and between which blades each shim should be inserted. Certain blades can then be removed and the required shims are added in their appropriate places as the removed stator blades are replaced into groove 20.

Figure 4:
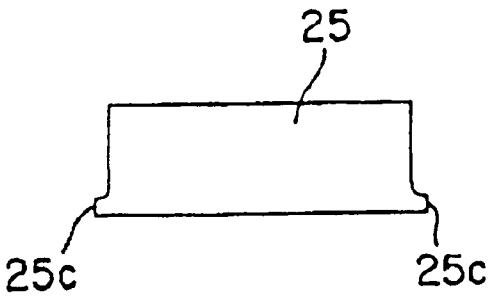
FIG. 4 (PRIOR ART)
FIG. 4 is a front view of the prior art shim of FIG. 3.
Figure 4A:
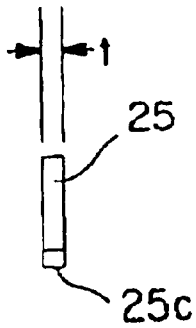
FIG. 4A (PRIOR ART)
FIG. 4A is an end view of the prior art shim of FIG. 4.

It should be recognized that shims will not normally be required between every set of adjacent stator blades but only between a selected few. In known axial flow compressors, the shims used are typically comprised of a flat plate 25 (FIGS. 3, 4, and 4A) of a hardened material, i.e. stainless steel, of different thicknesses whereby a shim can be selected for a particular situation. Each flat plate 25 has a pair of tabs 25*c* extending from either side at the bottom thereof which basically conform to the tabs 16*c* on blades 16 and which are adapted to slide into groove 20 to hold the shim 25 in place between two adjacent stator blades 16.

While the prior art, flat shims 25 function well to space and restrains movement of stator blades 16, each shim 25 will undergo continuous micro-motion and/or other forces which particularly act on tabs 25*c* to erode and wear away either one or both of the tabs. Accordingly, the real possibility always exists that the tabs 25*c* on one or more of the shims 25 will fail and break off under prolonged operation of the compressor. If and when this happens, the effected shim can work its way out of the space 26 (FIGS. 2 and 3) between the stator blades and into the interior of the compressor casing 11.

As will be recognized, a loose piece of metal (i.e. a loose shim 25) can do serious damage to both the stator blades 16 and the rotating rotor blades 15. Further, once the broken shim no longer fills the space between adjacent stator blades, those blades are now free to start vibrating which likely will lead to a catastrophic failure of the compressor 10.

Figure 5:
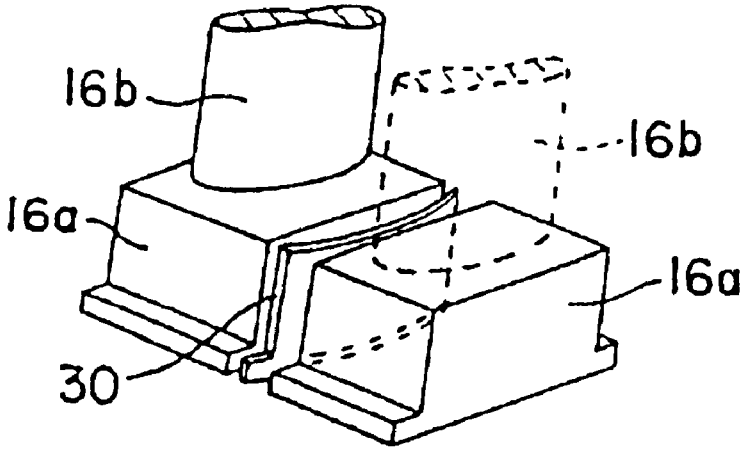
FIG. 5 is an enlarged, perspective view of two, adjacent stator blades, partly broken away, showing the shim of the present invention therebetween.
Figure 6:
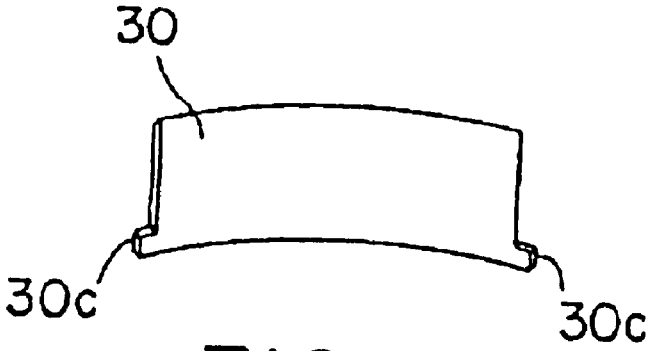
FIG. 6 is a front view of the present shim of FIG. 5.
Figure 6A:
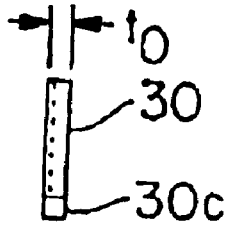
FIG. 6A is an end view of the present shim of FIG. 6.
Figure 6B:
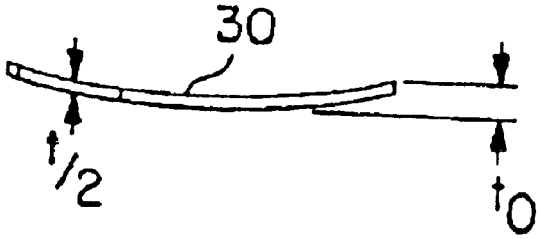
FIG. 6B is a top view of the present shim of FIG. 6.

In accordance with the present invention, a resilient spacer 30 (FIGS. 5–6B) is used between adjacent stator blades to space and restrain movement of the blades as they are properly positioned in groove 20 within casing 11. Preferably, resilient spacer 30 is basically a resilient, curved plate (e.g. effectively a leaf-spring) made from a corrosion-resistant, hardened material such as stainless steel, metal alloys, etc. Plate 30 has a tab 30*c* extending from either side at the bottom thereof which basically conforms to the tabs 16*c* on blades 16 and which are adapted to slide into groove 20 to hold the shim 30 in place between two adjacent stator blades 16.

The respective overall thicknesses "$t_o$" (as viewed in FIGS. 6A and 6B) of different sized, individual spacers or shims 30 will basically correspond to the respective thicknesses "t" of the prior art, flat shims 25 (FIG. 4A) so shims 30 can be selected for a particular situation basically in the same manner as in the prior art. However, preferably, shims 30 will be slightly preloaded under slight compression when in place between two stator blades. As used herein and in the claims, "overall thickness" is equal to the height (i.e. "$t_o$" in FIG. 6B) of shim 30 at its highest point when laid on a flat surface. To provide the resiliency desired, the actual thickness "t/2" of shim 30 (FIG. 6B) will preferably be approximately half the thickness "t" of flat shim 16 and will be shaped in an arc to produce the overall thickness $t_o$.

A row of stator blades 16 are assembled into a groove 20 in casing 11 in the same manner as described above except resilient spacers 30 are used instead of the prior art, flat shims 25. Resilient spacers 30 space adjacent stator blades 16 and restrain their movement as before but now the aerodynamic loads present during operation of compressor 10 will compress/relax the resilient spacers 30 thereby virtually eliminating the micro-motion and inter-fretting previously experienced by the prior art, flat shims 25.

What is claimed is:

1. An axial flow compressor comprising:

a stator casing having at least one internal circumferential groove therein;

a plurality of individual compressor stator blades positioned within said at least one internal circumferential groove wherein a space exists between at least two of said stator blades;

a leaf spring spacer consisting of a corrosion-resistant, hardered material, said spacer having a tab extending from each side thereof and adapted to fit said internal circumferential groove of said casing positioned within said at least one internal circumferential groove and in said space between said at least two of said stator blades; and a rotor having a plurality of rotor blades adapted to cooperate with said plurality of stator blades to compress a gas as said gas flows through said stator housing.

2. The axial flow compressor of claim 1 wherein said corrosion-resistant material is stainless steel.

3. The axial flow compressor of claim 1 wherein said at least one internal circumferential groove comprises:

a plurality of internal circumferential grooves axially spaced along said stator casing;

a plurality of individual stator blades positioned within each of said plurality of internal circumferential grooves wherein a space exist between at least two of said stator blades in each of said plurality of internal circumferential grooves; and a leaf spring spacer positioned within each of said spaces within each of said plurality of internal circumferential grooves.

4. The shim of claim 1 wherein the overall thickness of said curved plate when in a relaxed state is substantially equal to the space between two adjacent stator blades into which said curved plate is to be positioned.

5. A method of assembling a row of stator blades into an internal circumferential groove within a stator casing of an axial flow compressor, said method comprising:

positioning a plurality of compressor stator blades within said internal circumferential groove; and positioning a leaf spring spacer consisting of a corrosion-resistant, hardened material, said spacer having a tab extending from each side thereof and adapted to fit into said internal circumferential groove of said casing into each space which exists between two adjacent stator blades.

* * * * *